United States Patent [19]

Fraser

[11] Patent Number: 4,929,144

[45] Date of Patent: May 29, 1990

[54] APPARATUS FOR LOADING RADIATOR FINS INTO TRAYS

[75] Inventor: Ian Fraser, Westcliff, Great Britain

[73] Assignee: Ford Motor Company, Dearborn, Mich.

[21] Appl. No.: 288,641

[22] PCT Filed: Jun. 15, 1987

[86] PCT No.: PCT/GB87/00418

§ 371 Date: Dec. 16, 1988

§ 102(e) Date: Dec. 16, 1988

[87] PCT Pub. No.: WO87/07855

PCT Pub. Date: Dec. 30, 1987

[30] Foreign Application Priority Data

Jun. 17, 1986 [GB] United Kingdom ..... 8614753

[51] Int. Cl.[5] ..... B65G 57/28; B21D 53/08

[52] U.S. Cl. ..... 414/799; 53/542; 414/798.8

[58] Field of Search ..... 414/799, 798.8; 198/406, 431; 53/542, 534, 251

[56] References Cited

U.S. PATENT DOCUMENTS

| | | | |
|---|---|---|---|
| 2,859,859 | 11/1958 | Winkel et al. | 198/431 |
| 3,126,105 | 3/1964 | Marguet | 414/789.8 |
| 4,193,489 | 3/1980 | Siniscal | 198/406 |
| 4,321,739 | 3/1982 | Martin et al. | 29/157.3 A |

FOREIGN PATENT DOCUMENTS

| | | | |
|---|---|---|---|
| 531862 | 8/1931 | Fed. Rep. of Germany | 198/406 |
| 2355746 | 1/1978 | France . | |
| 2519888 | 7/1983 | France . | |

*Primary Examiner*—David H. Brown

*Attorney, Agent, or Firm*—Jerome R. Drouillard; Roger L. May

[57] ABSTRACT

The apparatus comprises an input conveyor 10 for transporting the fins in a horizontal attitude and lengthways, a part-cylindrical chute 22 disposed with its convex surface facing upwards and its axis of curvature generally horizontal and parallel with direction of movement of the input conveyor 22, the upper end of the chute being contiguous with the end of the conveyor 10. A tray 28 into which the fins are to be loaded is supported beneath the chute 22 with a slot adjacent the lower edge of the chute, and a deflector 20 acts to divert fins from the conveyor 10 to cause the fins to slide over the surface of the chute 22 and fall into the slot in the tray aligned with the lower edge of the chute.

5 Claims, 2 Drawing Sheets

APPARATUS FOR LOADING RADIATOR FINS INTO TRAYS

BACKGROUND OF THE INVENTION

1. Field of the Invention

The present invention relates to apparatus for loading of radiator fins into trays.

2. Discussion of the Related Arts

In certain types of radiators used in motor vehicles the cooling water flows through flat tubes which extend between two header tanks and the heat dissipation area is increased by means of convoluted fins which are fixed to the tubes and lie in the spaces between the tubes.

In the manufacture of such radiators, the fins are typically made from a flat strip which is passed through rollers which form louvre-like slots in the strip and then convolute it into a zig-zag. Subsequently, the strip is cut into individual fins each as long as the distance between the header tanks and these fins are temporarily stored side by side in trays. The trays have slots for receiving the fins and are used in a separate assembly jig to slide the fins between the tubes prior to the tubes being brought together in the jig and the headers being fitted to the ends of the tubes.

From the latter assembly jig, the assembled radiator cores are transferred to a further station where the fins, the tubes and the headers are vacuum braised or sometimes soldered together. The core can then be fitted to the header tanks and painted to complete the radiator manufacture.

SUMMARY OF THE INVENTION

The above description has been given by way of background only and the invention is concerned only with the step of loading the fins side by side in horizontal trays after they have been formed and cut from the continuous strip.

Normally the steps of slotting and convoluting the strip are carried out with the strip lying horizontally. This assists in the transportation of the fin material on a conveyor belt for after the convolutions have been made each fin behaves as a long weak spring and is too flexible to be easily transported vertically. On the other hand when loaded in trays as individual fins, the plane of the strip must be vertical for it is in this attitude that the fins are introduced between the flat tubes. It is therefore necessary when loading the trays from the continuously produced fins to turn each fin onto its side, introduce the fin into the appropriate slot in the tray, and then move the tray on by one slot in readiness for the next fin.

One method previously employed for this purpose involves the use of a horizontal drum having radial slots around its periphery for receiving the individual fins as they are still horizontal. The fins are fed into the drum at the 3 o'clock or 9 o'clock position and are carried round the 6 o'clock position where they drop into the slots of the tray. Rotation of the drum is synchronised with the cutting of the fins and with the movement of the trays.

This known construction suffers from many disadvantages. First, the indexing of the drum and of the trays must be in synchronism with the cutting of the individual fins from the continuous convoluted strips. This in itself requires a complex and costly mechanism. The complexity necesitates accurate setting up of the loading part of the fin making machine and the machine is prone to frequent stoppages because the loader does not operate correctly if the fins are defective in certain respects. Because of the inter-dependence between the loading and the fin forming parts of the machine a fault in any part of the equipment causes a complete stoppage.

Furthermore, there is no facility for testing that a fin is correctly dimensioned until it has left the loader. This means that the loader must be run, even at the risk of its being jammed by an improperly formed fin, before a fin can be tested for tolerance and enough fins must be passed to fill all the slots in the horizontal drum lying between the 9 o'clock and the 6 o'clock positions.

With a view to mitigating at least some of the above disadvantages, the present invention provides an apparatus for loading convoluted radiator fins into parallel slots in a tray, characterised by an input conveyor for transporting the fins in a horizontal attitude and lengthways, a part-cylindrical chute disposed with its convex surface facing upwards and its axis of curvature generally horizontal and parallel with direction of movement of the input conveyor, the upper end of the chute being contiguous with the end of the conveyor, means for supporting a tray beneath the chute with a slot adjacent the lower edge of the chute, and means for laterally deflecting a fin off the conveyor onto the chute to cause the fin to slide over the surface of the chute and, in doing so, to turn and fall in a vertical attitude into the slot in the tray aligned with the lower edge of the chute.

The fin is rotated through a right angle in the present invention by sliding over the surface of a convex chute. It is important to note that the fin id not laterally guides in the chute. This is in contrast with some earlier proposals in which the fins are passed through skewed guides of rectangular section to rotate their orientation either during insertion into the tray or during transfer to a second conveyor.

A problem with such a skewed rectangular guide is that the fin flops about as it moves along the guide because of its spring like behaviour and can become jammed in the guide. In this case removal of trapped fin is awkward. To assist in driving the fins along the guides so as to reduce the risk of blockage one can resort to blowing air along the guide but this adds still further complication and expense.

In the present invention, the chute can have a similar part-cylinder cover which can readily be opened to remove a trapped fin, but as there is less resistance to the movement of the fin the risk of blockage is in any event minimised.

The deflector is set such that at the speed of movement of the fin axially along the guide, as determined by the speed of the conveyor, the leading end of the fin travels tangentially through the ninety degrees necessary for it to enter the slot on the tray beneath the conveyor by the time it reaches the end of the tray. On entering the tray the fin comes to a stop and a wave travels back down the length of the fin causing the fin to buckle. However, the remainder of the fin can now slide tangentially down the chute under the effect of gravity alone and as it is only loosely guided it experiences no resistance to prevent it from falling into place in the tray.

It is necessary to index the tray by one slot after the slot beneath the lower edge of the chute is filled. In the prior art the tray movement has been synchronised with the production of the fins.

In the preferred embodiment of the invention, means are provided to detect the presence of a fin on the surface of the chute to provide a signal for a mechanism for indexing the trays one slot at a time beneath the lower edge of the chute. The operation of the loading apparatus is therefore separated from the forming of the fins, and if fins are fed from an alternative source onto the conveyor, for example by hand, the loading apparatus can function even if the fin forming apparatus is inoperative.

The conveyor can act to isolate the tray loading apparatus from the fin forming apparatus. In the event of a breakdown of the tray loading apparatus, it is possible to deflect formed fins into a temporary storage area alongside the conveyor so that the fin forming apparatus can continue to produce fins during the down time of the tray loading apparatus. The fins from the buffer store can subsequently be transferred manually or automatically onto the the conveyor when the fin forming apparatus is inoperative.

Clearly, the separation of the existing machines into two separate and independent modules reduces the overall down time even if the reliability of the individual modules is not improved.

The conveyor can be arranged to deflect fins after they have been formed for test purposes as most breakdowns in the loading device are caused by the fins being formed outside the acceptable tolerances. The invention allows the first or any desired fin in a batch to be diverted and tested so that risk of blockage of the loading apparatus is minimised. It is not necessary to produce numerous fins before one can be tested nor does the fin tested have to have passed through the loading apparatus.

The deflecting means is preferably adjustable to enable the loading device to operate with different fins and/or with fins travelling at different speeds along the conveyor.

A selectively operable deflector is preferably provided along the conveyor for deflecting formed fins away from the loading apparatus, for example into the temporary storage area described above. The latter deflector may comprise a jet of air but preferably comprises a solenoid actuated guide for shunting the fins off the conveyor.

BRIEF DESCRIPTION OF THE DRAWINGS

The invention will now be described further, by way of example, with reference to the accompanying drawings, in which.

DESCRIPTION OF THE PREFERRED EMBODIMENT

Figure 1:
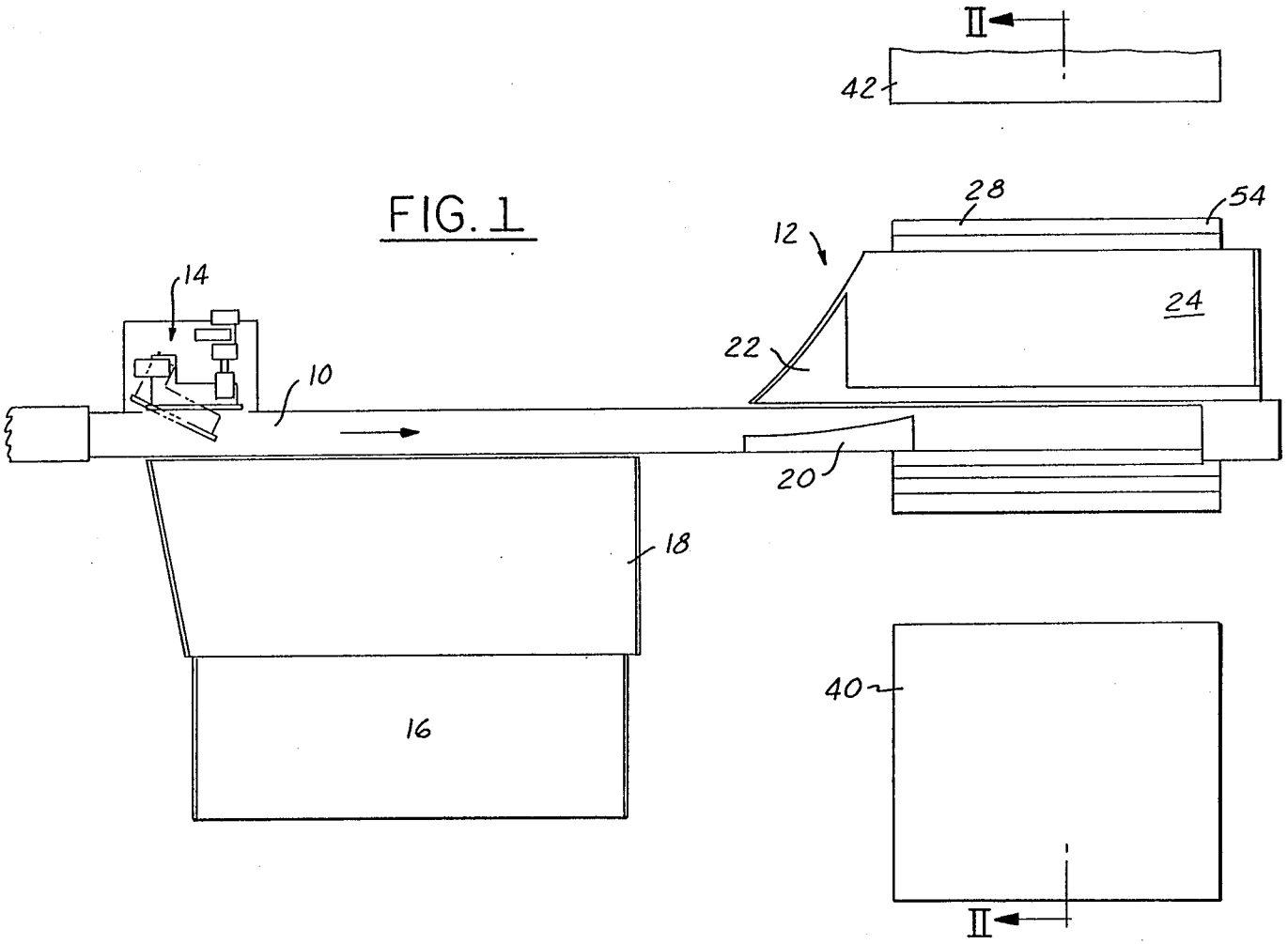
FIG. 1 is a plan view of a loading apparatus.

An input conveyor 10 extends between a fin forming apparatus (not shown) disposed to the left of the conveyor 10, as viewed in FIG. 1, and a tray loading apparatus which is generally designated 12. A solenoid actuated deflector 14 is disposed along the conveyor 10 at its end near the fin forming apparatus which when actuated (as shown in dotted lines) deflects fins travelling on the conveyor 10 onto a slide 18 leading to a storage area 16. A stock of trays may be disposed by the storage area 16 and if required, fins deflected from the conveyor 10 can be loaded manually into trays from this storage area.

Figure 2:
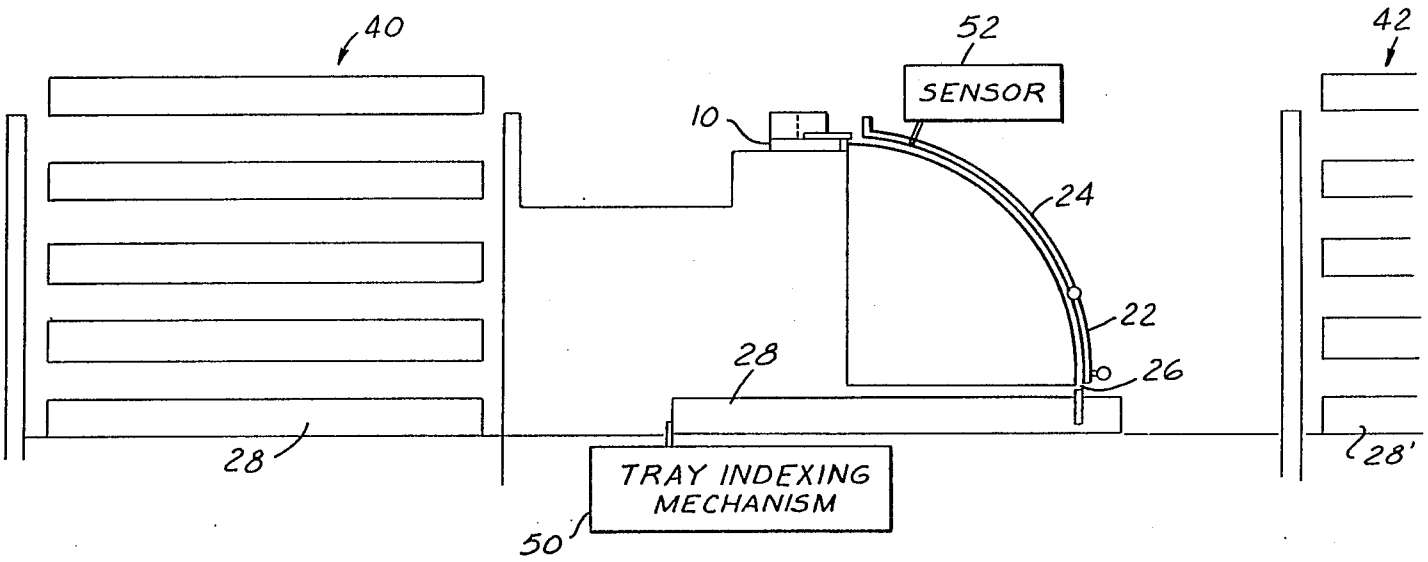
FIG. 2 is a section along the line II—II in FIG. 1.

A fixed second deflector 20 is arranged above the conveyor 10 at the tray load apparatus 12 to deflect the fins on the conveyor onto a part cylindrical chute 22 shown more clearly in FIG. 2. The chute 22 has a hinged cover 24 which defines with the chute a part cylindrical guide forcing the fins to topple onto their sides as they slide tangentially over the surface of the chute 22. The lower edge 26 of the chute 22 is disposed above a slot in a tray 28 which is indexed by one slot after each slot has been filled to present to the chute an empty slot for the next fin.

The indexing mechanism 50 for the trays may be conventional and is not therefore described in detail. The mechanism picks up empty trays from an input stack 40 and after the slots 54 in the trays have been filled with fins, one at a time, the full 28' trays are passed to an output stack 42.

Conventionally, the indexing of the tray 28 is synchronised with the formation of the fins but in the apparatus described a sensor (52) is placed on the chute to detect when a fin passes through the tray loading apparatus and causes indexing of the receiving tray 28 after each sensing of a fin. Thus fins may be placed on the conveyor 10 manually from the storage area 16 and can be loaded into the trays automatically. The sensor 52 may be any form of transducer sensitive to the passage of a fin and may operate optically or electromagnetically. The sensor 52 may furthermore be positioned at any point beyond which loading of a fin into a receiving slot in a tray is inevitable.

The fin is not guided laterally during its sliding over the surface of the chute 22 and the probability of jamming is small. However, even in such an eventuality, the hinged cover 24 affords easy access for removal of any damaged fin which could otherwise cause a blockage.

During the time that the cover 24 is opened, or in response to automatic detection of jamming, the deflector 14 may be switched on to divert further formed fins into the temporary storage area 16 so that the blockage in the tray loading apparatus 12 may be cleared. This avoids damage being caused to the fins in the tray loading apparatus 12 and further aggravation of the blockage. Once the loading apparatus is again rendered operative, the fins in the storage area 16 can be manually loaded onto the conveyor 10 during a down time of the fin forming apparatus, for example when a supply roll of the aluminium strip from which the fins are formed is changed. If trays are required urgently during a prolonged breakdown of the tray loading apparatus 12, fins can be loaded manually into the trays from the temporary storage area 16.

The length of the chute 22 and the angle of the deflector 20 must be selected such that the leading end of a fin just reaches the edge of the receiving slot in the tray 28 after it has turned through a right angle and comes to rest in the slot. The abrupt stoppage sends a wave along the fin causing the latter to buckle and it is important that the fin should be only loosely guided between the chute 22 and its cover 24 if this buckling is not to cause jamming. With the leading end correctly aligned in the slot in the receiving tray 28, the tail of the fin reliably drops into place under gravity and the guiding effect of the sides of the slot in the tray.

It is preferable that the deflector 20 should be adjustable to suit different conditions, that is to say to allow for different conveyor speeds and lengths of fin.

It is of course an important advantage of the invention that the part of the tray loading apparatus responsible for changing the orientation of the fins has no moving parts. This makes for reliability, less expensive construction and much simpler setting up procedures.

The layout described also effectively separates the fin forming apparatus from the loading apparatus and the need for synchronisation between the two is obviated.

I claim:

1. Apparatus for loading convoluted radiator fins into parallel slots in a tray, characterised by an input conveyor (10) for transporting the fins in a horizontal attitude and lengthways, a part-cylindrical chute (22) disposed with its convex surface facing upwards and its axis of curvature generally horizontal and parallel with direction of movement of the input conveyor (10), the upper end of the chute being contiguous with the end of the conveyor, means for supporting a tray (28) beneath the chute with a slot adjacent the lower edge of the chute (22), and means (20) for laterally deflecting a fin off the conveyor (10) onto the chute (22) to cause the fin to slide over the surface of the chute (22) and, in doing so, to turn and fall in a vertical attitude into the slot in the tray (28) aligned with the lower edge of the chute (22).

2. Apparatus as claimed in claim 1, wherein chute (22) is provided with a hinged part-cylindrical cover (24).

3. Apparatus as claimed in claim 1, wherein means are provided to detect the presence of a fin on the surface of the chute (22) to provide a signal for a mechanism for indexing a tray (28) one slot at a time beneath the lower edge of the chute (22).

4. Apparatus as claimed in claim 1, wherein a storage area (16) is provided alongside the conveyor (10) to enable temporary storage of fins.

5. Apparatus as claimed in claim 4, wherein a selectively operable further deflector (14) is provided for deflecting fins from the conveyor (10) into the temporary storage area ( 6).

* * * * *